United States Patent [19]

Ferri et al.

[11] Patent Number: 4,961,260

[45] Date of Patent: Oct. 9, 1990

[54] COMPRESSOR CARTRIDGE SEAL AND INSERTION METHOD

[75] Inventors: James Ferri, Northampton, Pa.; Norman A. Samurin, Allegany, N.Y.

[73] Assignee: Dresser-Rand Company, Corning, N.Y.

[21] Appl. No.: 310,242

[22] Filed: Feb. 13, 1989

[51] Int. Cl.[5] ..... B23P 15/02; F16J 9/00

[52] U.S. Cl. ..... 29/888.025; 277/1; 277/38; 277/96; 277/96.1; 415/199.1; 415/230

[58] Field of Search ..... 277/1, 11, 30, 55, 67, 277/96, 96.1, 38; 415/170.1, 199.1, 198.1, 229, 230; 29/156.4, 156.8 R, 428

[56] References Cited

U.S. PATENT DOCUMENTS

| | | | |
|---|---|---|---|
| 1,705,016 | 3/1929 | Jack | 415/230 |
| 2,113,167 | 4/1938 | Baumheckel | 415/170.1 X |
| 3,042,414 | 7/1962 | Tracey . | |
| 3,456,318 | 7/1969 | Fritsch | 29/156.8 R |
| 3,601,412 | 8/1971 | Malmstrom . | |
| 4,039,196 | 8/1977 | Inouye . | |
| 4,172,310 | 10/1979 | Mincuzzi | 29/156.4 R |
| 4,332,391 | 6/1982 | Arnold . | |
| 4,397,470 | 8/1983 | Carroll et al. . | |
| 4,415,164 | 11/1983 | Johnson . | |
| 4,416,458 | 11/1983 | Takenaka et al. . | |
| 4,427,204 | 1/1984 | Alley . | |
| 4,463,956 | 8/1984 | Malott . | |
| 4,538,820 | 9/1985 | Duffee . | |

OTHER PUBLICATIONS

Ingersoll Rand: "Centregal Compressors", printed 1984, 12p. Color Brochure (form 3397-C).

Kaydon Inc.: "Dry Gas Seals"; no printing date given, 2 p. color brochure (form 08-88).

Dresser-Rand: "Centregal Compressor Design Features", no print date given, 1 p. illustration (form C-0039).

Dresser-Rand: "Centregal Compressors", no print date given, 1 p. description (form C-0038).

*Primary Examiner*—Allan N. Shoap

*Assistant Examiner*—Scott W. Cummings

[57] ABSTRACT

A high pressure compressor seal assembled onto a compressor shaft, together with compressor bundle elements. A stationary bundle vane is engaged with slots within the seal to prevent rotation of an outer portion of the seal during operation of the compressor. In addition, the stationary vanes engage groves in the seal so that when the bundle elements are inserted into the compressor, the seal can be pushed into a housing opening.

8 Claims, 2 Drawing Sheets

COMPRESSOR CARTRIDGE SEAL AND INSERTION METHOD

TECHNICAL FIELD OF THE INVENTION

The present invention relates in general to compressor fluid seals and methods of installation thereof, and more particularly to a seal which can be initially installed on a compressor bundle shaft and inserted into the compressor housing and fixed therein with the compressor bundle equipment.

BACKGROUND OF THE INVENTION

Pipeline compressors are heavy and huge equipment adapted for compressing very large volumes of gas to high pressures, ranging up to 10,000 psi. Despite the size of such equipment, the internal rotating and stationary parts thereof, such as the impellers, diffusers, vanes, volutes, etc., are machined with an extremely high degree of precision so that the moving parts remain operable over a wide temperature range to provide a reliable and highly efficient compressor. The compressor shaft, which itself may be on the order of 6–10 inches in diameter, requires precision bearings so that rotation of the compressor bundle, including the shaft, rotors, impellers and diaphragm structures, can turn at a high speed, in close tolerance with the stationary parts. Often, such compressors are driven by a turbine engine with a 4,000–40,000 horsepower rating at speeds up to ten thousand revolutions per minute.

The assembly, disassembly and maintenance of such compressors requires the use of winches and/or roller dollies to accurately mate the parts together or to provide for safe disassembly thereof. In a barrel-type, or vertically split pipeline compressor, the housing comprises a heavy cylinder in which the compressor bundle is inserted laterally by the use of winch equipment. The compressor bundle is laterally moved into the barrel housing and thereafter the bearings and seals are installed between the shaft and the housing ends or heads. Often this can be accomplished by personnel reaching into the housing end through a small opening to assemble the seal on the shaft end and fix it in place. This not only requires a precise alignment between the compressor shaft and housing heads, but also additional time and labor in installing the bearings and seals. Such assembly can also present a safety hazard, especially with personnel working with the large and heavy equipment.

It can be seen from the foregoing that a need exists for an improved high pressure cartridge seal and method of installation thereof to facilitate assembly of compressor equipment.

SUMMARY OF THE INVENTION

In accordance with the invention, there is disclosed an improved cartridge seal and method of installation thereof which eliminates or substantially reduces the disadvantages and shortcomings of prior seals and associated techniques. According to the invention, the improved seal includes conventional labyrinth and carbon seal elements defining a smaller diameter seal part which remains fixed to a rotatable bundle shaft. A larger diameter annular seal part includes multiple O-rings which remain fixed with respect to the compressor housing. The smaller diameter section of the seal has a polygonal bore and is fixed to a part of the bundle shaft which is similarly shaped. The large diameter section of the seal has radial grooves formed therein for engagement with stationary vanes defining a part of the compressor bundle. The rotating part of the seal is thus fixed to the bundle shaft, while the stationary part is fixed with respect to the compressor housing through engagement of the stationary vanes.

During installation of the compressor bundle into the housing, the seal is rotatably fixed to the bundle shaft by the noted polygonal shaped mating elements. The stationary vanes are then arranged on the shaft, as well as the remaining elements of the compressor bundle, and the entire bundle assembly is then inserted laterally into the cylindrical compressor housing. As the compressor bundle is pushed into the housing, the stationary vanes are effective to apply a uniform and lateral force around the cartridge seal and force it into an opening in the end wall, or intake head, of the compressor housing. The entire installation of the seal is thus carried out simultaneously with the insertion of the compressor bundle, thereby facilitating assembly of the compressor and eliminating the requirement of separate seal installation steps carried on from outside of the compressor.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements through the views, and in which.

DETAILED DESCRIPTION OF THE INVENTION

Figure 1:
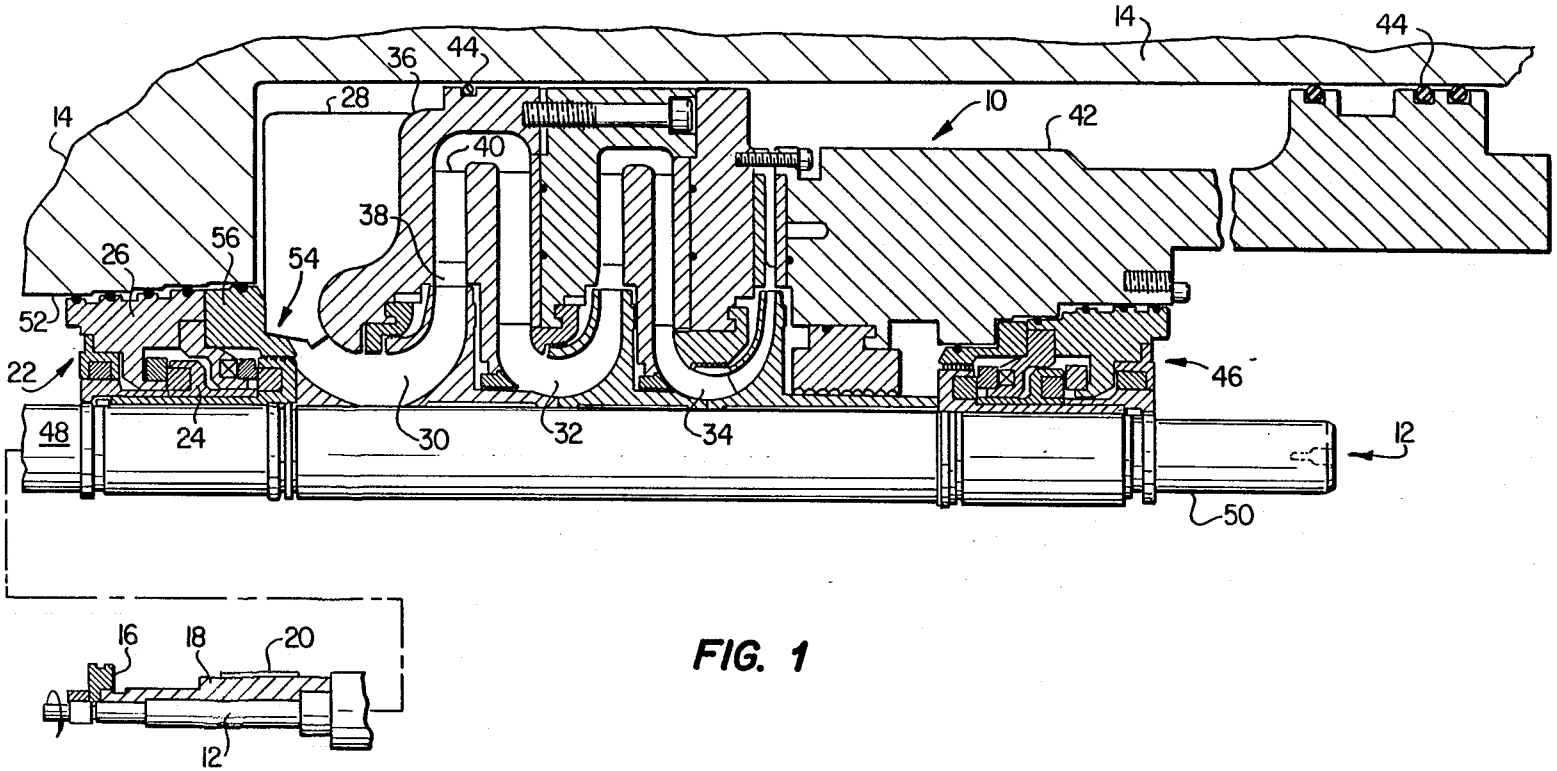
FIG. 1 is a cross-sectional view of the major components of a vertically split compressor after final assembly.

FIG. 1 illustrates a major part of a pipeline compressor of the type in which the invention may be advantageously practiced. It is to be understood that the type of compressor shown is not in any manner restrictive of the applications of the seal or the installation technique.

Particularly illustrated are the major component parts of a compressor bundle 10 which are utilized in conjunction with a compressor housing for pressurizing a fluid, generally a gas, at high volumes and high efficiencies. The compressor to which the invention is well adapted for use comprises a three barrel, vertically split centrifugal compressor, known as a "Centregal" compressor, obtainable from Dresser-Rand, Olean, N.Y. During assembly according to the invention, the compressor bundle is arranged around a central compressor shaft 12, together with the requisite bearings and seals, and thereafter the entire composite assembly is moved into a heavy duty compressor housing 14 and fixed therein. Numerous assembly problems encountered during the compressor assembly, including those noted above with regard to the assembly of the high pressure seals between the shaft 12 and the compressor housing, are avoided by the invention.

The illustrated compressor bundle 10 illustrates the major components, many of which are not significant to the utilization or adaptation of the present invention. Nevertheless, depicted as part of the compressor bundle is the shaft 12 which has a number of graduations or shoulders along its length to accommodate various gear drives, seals, bearings and the multistage compressor impeller and associated apparatus for achieving the compression of a fluid. The intake stage of the compressor bundle 10 appears to the left of FIG. 1, which is also the end of the bundle 10 which is first inserted into a cylindrical compressor housing during final assembly thereof. For purposes of clarity, the various parts of the compressor bundle 10, as well as the seals, are shown as sectional views of an upper portion thereof, it being realized that such components are symmetrically oriented entirely around the shaft 12.

A thrust bearing collar 16 is arranged with respect to the intake end of the compressor shaft 12 to counteract axial loads imposed thereon as a result of the compressor action of the impellers. The compressor shaft 12 has fixed thereto an annular pinion shroud 18 which is employed in conjunction with an annular set of pinion gear teeth 20 for driving the compressor shaft 12. While not shown, a frontal bearing is employed between the thrust bearing 16 and the shouldered part of the shroud 18 to provide support to the intake end of the shaft 12. Also not shown is a large drive gear assembly which is bolted to the intake end of the compressor for providing a gear drive to the pinion gear 20.

Proceeding interiorly with regard to the compressor shaft 12, there is provided a high pressure seal 22 which has a smaller diameter portion 24 fixed with respect to the compressor shaft 12 and a larger diameter part 26 which is fixed with respect to the compressor housing 14. The primary function of the high pressure seal 22 is to isolate the high gas pressures generated within the compressor from the exterior of the compressor.

A stationary portion of the compressor bundle 10 includes a pair of diametrically opposed vanes 28 oriented in an arbitrary direction, but shown vertically in the illustration of FIG. 1. Numerous other vanes can be employed, depending on the need. One or more compressor impellers 30, 32 and 34 are fixed to the compressor shaft 12 and rotate therewith to provide a radial compression of the gas which is initially funneled to the intake impeller 30, via the pair of stationary vanes 28. The impellers 30–34 operate within respective diffuser passages formed within a bundle casing 36. One diffuser passage is shown as reference character 38. Formed within the various diffusers, and arranged annularly around the compressor shaft 12 may be a number of stator vanes 40 which transform a velocity pressure of the gas imparted thereto by the impeller 30, into a static pressure which is delivered around the diffuser section to either a subsequent impeller stage, or to an output of the compressor. The compressor bundle case 36 is constructed in a number of parts, such as a intake part 36 and a back or discharge part 42, and others, all of which can be fastened together and sealed by various seals. In addition, the compressor bundle case is formed with a number of annular grooves therearound to accommodate large diameter O-rings, such as indicated by numerals 44. The large diameter O-rings provide a seal between the compressor bundle 10 and the compressor housing 14. Of course, the compressor bundle intake case part 36, in which the diffuser passages 38 are formed, and the discharge case part 42 are fixed with respect to the compressor housing 14, and thus do not rotate with the compressor shaft 12. Located adjacent the discharge part of the compressor bundle 10 is another high pressure seal 46 for isolating the interior portion of the compressor from the outside thereof, and thereby maintain the pressurized gas within the compressor and routed therethrough by the various channels. While not shown, the compressor shaft 12, and the bundle apparatus fixed thereto, such as the impellers 30–34 are rotatably supported by an intake bearing (not shown) attached to shaft area 48 and a discharge bearing (not shown) fixed at shaft area 50. The intake bearing and discharge bearing are of conventional design for rotatably mounting the compressor shaft 12 and associated bundle parts to end walls (not shown) of the compressor housing.

In a typical assembly of previous vertically-split type of compressors, the bundle 10 is fully assembled, except for the intake high pressure seal, and inserted into the cylindrical compressor housing 14 from the discharge end. When the shaft 12 is moved laterally into the cylindrical housing proximate an intake end wall thereof, assembly persons must reach into a small gear box frontal opening of the compressor and align the seal between the shaft 12 and an opening 52 within the housing end wall. In addition, the smaller diameter part 24 of the seal must be pinned, keyed or otherwise fixed to the compressor shaft 12, while the entire bundle unit is suspended within the cylindrical housing 14. After proper alignment and fixing the seal to the shaft 12, the compressor bundle 10 is inserted the remaining distance within the compressor housing 14 such that the intake and discharge bearings, which are mounted to the shaft 12, are fitted within appropriate openings within respective sidewalls of the compressor housing to support the compressor bundle 10. The rear high pressure seal 46 can generally be installed without the attendant problems associated with the front seal 22.

In accordance with an important feature of the invention, the frontal high pressure seal 22 includes a three-lobed polygonal bore which is initially mounted on a corresponding polygonal shaped area of the compressor shaft 12, in engagement with the diametrically opposed pair of stationary vanes 28. The entire bundle 10, including the front and back bearings and the intake seal 22 are laterally inserted into the cylindrical compressor housing 14. When the frontal seal 22 is proximate the opening 52 within the frontal side wall of the compressor housing 14, no operator intervention is required. Rather, all that is required is for a force to be applied to the rear portion of the compressor bundle 10. In this manner, with the opposing vanes 28 engaging at corners 54 thereof with the intake high pressure seal 22, the seal 22 can be forced into the opening 52 and set therein. Because the stationary vanes 28 are engaged within slots formed within the large diameter seal part 56, the entire seal 22 is forced into a home position within the compressor housing opening 52. Importantly, the vanes 28 engage the seal part 56 symmetrically therearound, and thus a uniform force is applied to the back portion of this high pressure seal 22 so that it, along with the compressor shaft 12, can be moved as a complete unit to a home position within the cylindrical compressor housing 14. The uniform force applied to the seal 22 allows the elastomer seal rings therearound to become seated within corresponding annular areas of the opening 52 within the housing 14.

Figure 2:
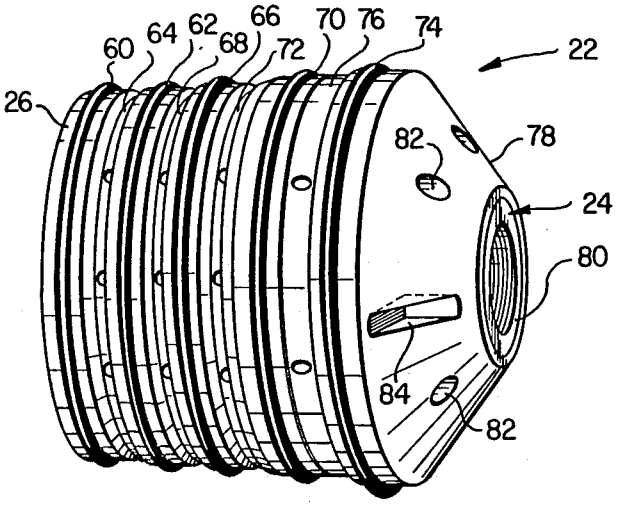
FIG. 2 illustrates an isometric view of the cartridge seal of the invention.

The high pressure seal 22 of the invention is illustrated in FIG. 2. Except for the modifications according to the invention, the general construction of the high pressure seal 22 is similar to that obtained from Kaydon Seal Company, Baltimore, Md., as seal type 102773. The seal 22 is a type having a rear primary carbon seal and forward secondary carbon seal, defining a tandem seal. Redundancy is thereby provided in the event the primary seal begins leaking, the secondary seal prevents leakage of compressed gas to the outside of the compressor, and thus to the atmosphere. Various buffer seals are provided internally to also facilitate detection of leakage of the various fluid chambers within the seal. External elastomer O-rings 60 and 62 provide an annular seal between the high pressure seal 22 and the compressor housing opening 52. More particularly, such O-rings provide a seal for an annular channel 64 in which a buffer gas can be injected through channels within the compressor housing 14 into the seal 22, thereby counteracting the pressures generated within the compressor by the impellers 30–34. In like manner, O-rings 62 and 66 provide isolation for a channel 68 utilized as a vent and liquid drain for the seal. O-rings 66 and 70 isolate a channel 72 to provide an inner seal pressure connection for ascertaining the condition of the primary carbon seal during normal operation of the compressor. Finally, O-rings 70 and 74 isolate an annular channel 76 so that a high pressure gas can be injected therein, and if a leakage occurs within the primary carbon seal, a resultant leakage gas can be detected in the annular channel 72.

The rear end of the high pressure seal 22 comprises an aluminum collar 78 having internal annular labyrinth type teeth for providing a seal to a cylindrical seal part 80 which is fixed to the compressor shaft 12. The seal part 80 defines the smaller diameter part 24 describes above. The labyrinth seal is of conventional design for providing a seal between the internal and outer portion of the seal 22. Holes, 82 are formed axially within the seal part collar 78 for fastening the seal parts together with threaded hex-head bolts.

Importantly, the high pressure seal 22 includes a pair of opposed slots in the collar 78, one shown as numeral 84. The slots 84 receive therein the respective corners 54 of the stationary bundle vanes 28. With such an engagement, and because the bundle vanes 28 remain stationary with respect to the compressor housing 14, the larger diameter part 26 of the high pressure seal 22 also remains stationary during compressor operation. Pinning or keying of the seal 22 to the compressor housing 14 is thereby eliminated. In addition, the engagement of the slots 84 by the vane corners 54 allows pressure to be applied to the seal 22 when pushed into the housing opening 52, as described above. While only a pair of opposed slots 84 are employed, the number and shape of the slots may be varied in correspondence with the number and shape of the vanes 28 employed in the compressor. Moreover, while vanes 28 are engaged with the high pressure seal 22 in the preferred embodiment of the invention, other bundle apparatus could be employed as well.

Figure 3:
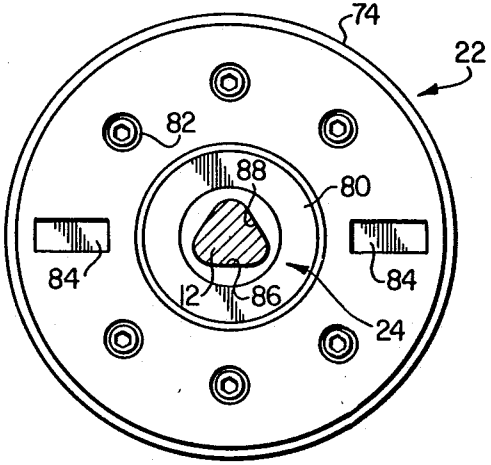
FIG. 3 is an end view of the high pressure cartridge seal of FIG. 2.

FIG. 3 depicts a plan view of the high pressure seal 22, as viewed from the rear end thereof. As can be seen, the slots 84 are symmetrical with respect to the high pressure seal 22, and in the preferred embodiment of the invention, comprise a diametrically located pair. According to another important feature of the invention, the smaller diameter seal housing portion 24 includes a three-lobed polygon-shaped bore 86, matching that of a similar shaped portion of the compressor shaft 12. The difference in eccentricity of the seal bore 86 and the outer surface of the compressor shaft 12 is about 0.015 inch, and thus the polygonal shape is very slight. Nevertheless, by employing a noncircular interface between the high pressure seal 22 and the compressor shaft 12, no pinning or keying is required, which otherwise would present balance problems which must be offset, or at least considered. A seal construction of the invention is thus self balancing. While the polygonal shape between the compressor shaft 12 and the high pressure seal part 24 is effective to rotationally lock such parts together, other key or pinning arrangements may be required for axially locking the parts together to facilitate insertion and removal of the seal 22 with the compressor bundle 10.

While the preferred embodiment of the invention has been disclosed with reference to a specific construction and method, it is to be understood that many changes in detail may be made as a matter of engineering choices without departing from the spirit and scope of the invention, as defined by the appended claims.

What is claimed is:

1. A method for assembling a compressor, comprising the steps of:

fixing a fluid seal assembly to a bundle shaft;

assembling compressor bundle parts together, including a stationary vane assembly, to said shaft;

engaging said stationary vanes with a portion of said seal assembly;

inserting said bundle shaft, said seal assembly and other bundle elements into a compressor housing; and pushing said bundle elements so that said stationary vane assembly forces said seal assembly into an opening in said housing.

2. The method of claim 1, further including engaging said stationary vane assembly with a portion of said seal assembly to prevent rotation thereof.

3. The method of claim 1, further including engaging said stationary vane assembly in slots of said a portion of seal assembly before inserting said bundle elements into said compressor housing.

4. The method of claim 1, further including pushing on said bundle elements so as to apply a uniform force to said seal assembly.

5. The method of claim 1, further including fixing said seal assembly to said shaft using an irregular shaped shaft part and a corresponding irregular shaped bore in said seal assembly.

6. The method of claim 5, further including using a polygon shaped shaft and a polygon shaped bore in said seal assembly.

7. A method for assembling a vertically split compressor, comprising the steps of:

inserting a seal assembly onto a compressor shaft so that a polygon shaped bore of said seal assembly mates with a polygon shaped shaft portion;

assembling stationary and rotatable compressor bundle elements around said shaft;

engaging stationary vanes of said bundle elements with slots in a portion of said seal assembly;

inserting the assembled bundle elements and shaft into a vertically split compressor housing;

pushing on said bundle assembly so that said seal assembly is pushed into a support structure opening of said housing; and supporting said bundle shaft with bearings so that the shaft and rotatable bundle elements are rotatable with respect to said housing, and said stationary vanes maintain engagement with said seal assembly to prevent said portion of said seal assembly from rotating.

8. The method of claim 7, further including uniformly pushing on said bundled assembly so that elastomer seals disposed around said seal assembly are sealed inside said support structure opening.

* * * * *

UNITED STATES PATENT AND TRADEMARK OFFICE

CERTIFICATE OF CORRECTION

PATENT NO. : 4,961,260

DATED : October 9, 1990

INVENTOR(S) : James Ferri et al.

It is certified that error appears in the above-identified patent and that said Letters Patent is hereby corrected as shown below:

Column 6, line 32, delete "in slots of said a portion of", insert --with slots in a portion of said--.

Signed and Sealed this

Tenth Day of March, 1992

*Attest:*

HARRY F. MANBECK, JR.

*Attesting Officer*

*Commissioner of Patents and Trademarks*